United States Patent [19]

Gerding

[11] Patent Number: 4,586,804

[45] Date of Patent: May 6, 1986

[54] PHOTOGRAPHIC PAPER HANDLING DEVICE AND METHOD

[76] Inventor: Gary H. Gerding, 4623 N. 93rd St., Omaha, Nebr. 68134

[21] Appl. No.: 661,964

[22] Filed: Oct. 17, 1984

[51] Int. Cl.[4] ..... G03D 3/00

[52] U.S. Cl. ..... 354/322; 354/330

[58] Field of Search ..... 354/312, 313, 314, 316, 354/320, 321, 322, 330, 329

[56] References Cited

U.S. PATENT DOCUMENTS

| | | | |
|---|---|---|---|
| 2,719,473 | 10/1955 | Butiigieg | 354/329 |
| 2,862,432 | 12/1958 | Schiller | 354/329 |
| 3,695,162 | 10/1972 | Wing | 354/330 |
| 3,705,544 | 12/1972 | Ratowsky | 354/329 |
| 3,856,395 | 12/1974 | Comstock | 354/312 |
| 4,074,298 | 2/1978 | Cartwright | 354/330 |

*Primary Examiner*—A. A. Mathews

*Attorney, Agent, or Firm*—Zarley, McKee, Thomte, Voorhees & Sease

[57] ABSTRACT

The photogrpahic paper handling device includes an elongated frame having a pair of opposite end walls connected together in spaced-apart relation by a plurality of brace rods extending between them. A drive shaft rotatably carried at upper portions of the end walls carries a pair of depending flexible bands for receiving and rotating a tubular paper carrier. Lower portions of the frame end walls are equipped with rollers or openings for precisely positioning the paper carrier for rotation by the bands in response to rotation of the drive shaft. The carrier may be provided as a large diameter tube adapted to carry prints interiorly thereof or as a pair of slit tubes onto which the opposite ends of a long paper roll may be wound. The paper is processed by sequential lowering of the frame into successive tanks of chemicals to the extent of submersion of the carrier with the carrier being rotated within the chemicals.

17 Claims, 11 Drawing Figures

PHOTOGRAPHIC PAPER HANDLING DEVICE AND METHOD

BACKGROUND OF THE INVENTION

The present invention is directed generally to an apparatus and method for handling exposed photographic paper during the processing thereof. More specifically, the present invention is directed to an elongated frame for rotatably supporting a photographic paper carrier on a lower portion thereof such that upon sequential placement of the frame and loaded carrier in successive tanks of chemicals to the extent of submersion of the carrier, the exposed paper is developed and processed.

There are many types of devices in the prior art for handling photographic paper during the processing stages but all of them have certain deficiencies. Several such handling devices include the chemical tanks into which the paper is inserted and these are necessarily therefore large cumbersome devices. Other devices roll the paper onto vertical posts and therefore require large quantities of chemicals to achieve sufficient depth for insertion of the vertical rolls. In still other devices, chemicals are added to the device and then disposed of for a one shot single use of the chemicals.

Particular problems are encountered in connection with the development of large photographic paper on the order of forty inches wide and as much as fifteen feet long for photo art displays and the like. Such large prints must be treated in developer, stop bath and fixer just like any other prints for developing. Problems associated with the handling of large prints include excessive pulling of the paper resulting in ripping, non-uniform development due to the temperature variations in the chemical baths, support devices which contact the exposed surface of the paper and inefficient consumption of chemicals. These and other problems associated with photographic paper handling devices of the prior art are believed to be resolved by the present invention.

Accordingly, a primary object of the invention is to provide an improved photographic paper handling device and method.

Another object is to provide such a device and method wherein multiple prints are supported and agitated for simultaneous processing with nothing touching the exposed surfaces of the paper but the processing chemicals.

Another object is to provide such a device and method adapted for gently handling large photographic paper without danger of creasing and ripping.

Another object is to provide such a device and method wherein the photographic paper is submerged within processing tanks of sufficient size that temperature variation is not a problem.

Another object is to provide such a device and method which accommodates the efficient multiple use of the chemical baths.

Finally, another object is to provide a photographic paper handling device which is simple in construction, economical to manufacture and efficient in operation.

SUMMARY OF THE INVENTION

The photographic paper handling device of the present invention includes a frame having opposite end walls and braces connected to and extended between the walls for supporting them in upright, parallel, spaced-apart relation. A drive shaft is rotatably supported on an upper portion of the end walls and a generally cylindrical photographic paper carrier is rotatably supported below the drive shaft and between the end walls. A drive mechanism disengageably connects the carrier to the drive shaft for rotation of the carrier in response to rotation of the drive shaft.

In one embodiment, the carrier is adapted to receive exposed photographic paper within it, which carrier has ends which are open for the flow of chemicals therethrough so that the handling device with the loaded carrier may be sequentially placed in successive tanks of chemicals to the extent of submersion of the carrier for developing the paper in the carrier.

In another embodiment of the invention, the carrier includes a pair of slit tubes which are adapted to receive and engage opposite ends of an elongated roll of photographic paper so that the paper may be rolled onto at least one of the slit tubes. The tubes are rotatably supported in spaced-apart relation on lower parts of the end plates and the drive means rotates the slit tubes in unison for rolling the paper from one slit tube to the other. Accordingly, upon sequential lowering of the handling device into successive tanks of chemicals to the extent of submersion of the slit tubes, and upon transfer of the paper from one slit tube to the other within the chemicals, the exposed paper is developed and processed. One end of each slit tube may be provided with a fixed collar and an annular recess spaced outwardly therefrom for receiving a split ring fastener for sandwiching an end wall between the collar and fastener to limit axial movement of the slit tube. The opposite end portions of the elongated roll of photographic paper are folded back toward the roll along a transverse crease so that upon axial insertion of the end portions within the slit tube such that the roll of paper extends outwardly through the slits, radial withdrawal of the ends of the paper through the slits is resisted.

Thus the present invention presents a simple compact device which accommodates the efficient multiple use of the separate chemical baths. The photographic paper is very gently handled without contacting the exposed surface being processed. Finally, even very large prints are easily and gently handled without danger of ripping.

DESCRIPTION OF THE PREFERRED EMBODIMENTS

Figure 1:
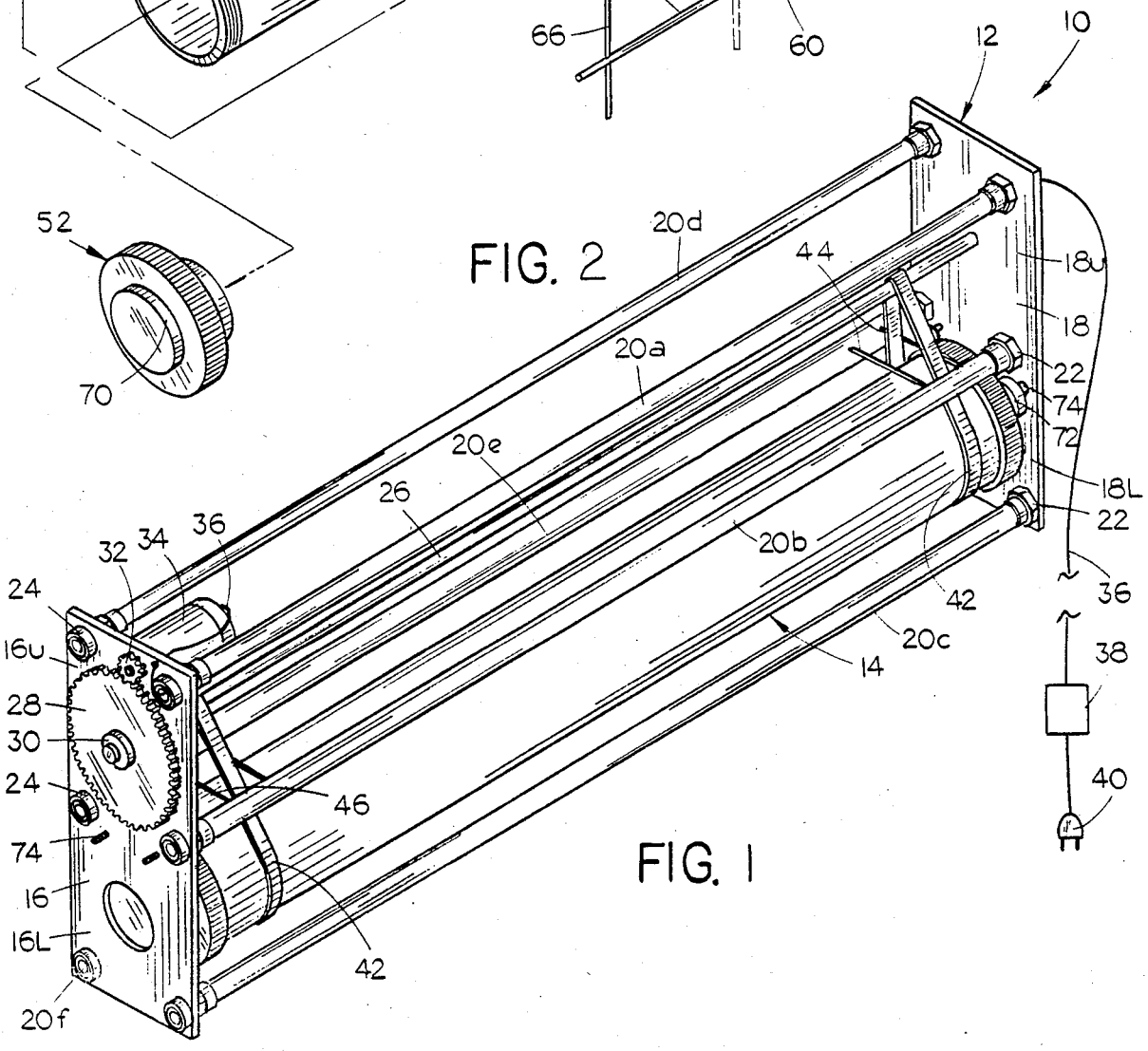
FIG. 1 is a perspective view of the paper handling device with a light tight tube supported therein.
Figure 6:
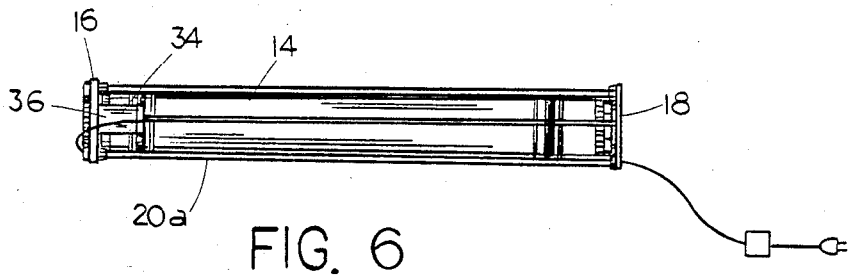
FIG. 6 is a top plan view thereof.
Figure 4:
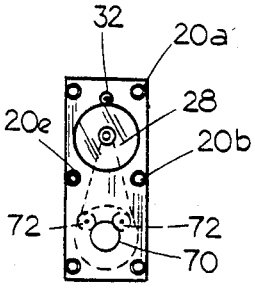
FIG. 4 is an elevational end view thereof.
Figure 3:
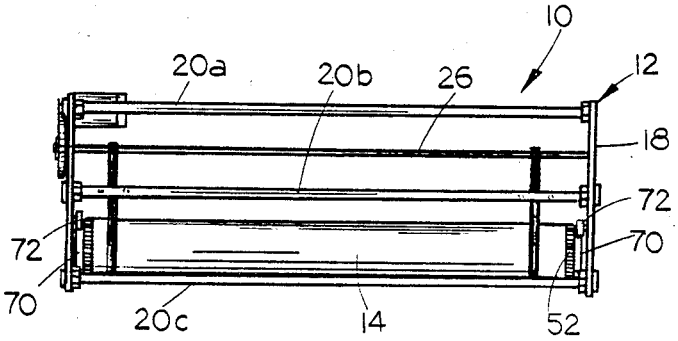
FIG. 3 is a side elevational view of the device of FIG. 1.
Figure 5:
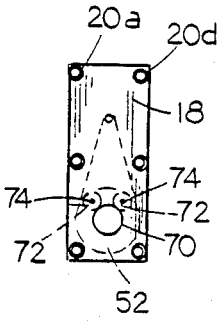
FIG. 5 is an elevational view of the opposite end.

The photographic paper handling device 10 of the present invention, shown in FIG. 1, comprises an elongated frame 12 for supporting a generally cylindrical photographic paper carrier 14.

Frame 12 includes a pair of opposite end walls 16 and 18 having respective upper and lower portions 16U, 18U and 16L, 18L and a series of six brace rods 20*a–f* connected to and extended between the end walls for supporting them in upright generally parallel spaced-apart relation. The end walls 16 and 18 are preferably formed of a clear plexiglass material and the brace rods are likewise made of a chemically inert plastic material such as common PVC tubing. The brace rods are provided with inner and outer fittings 22 and 24 on each end of each rod to secure the brace rods and end plates together in a rigid assembly. The brace rods extend through appropriate holes in the end plates.

A rigid drive shaft 26 of steel or like material is rotatably supported in centrally positioned openings through upper portions 16U and 18U of the end plates. A driven gear 28 is fixedly secured on one end of drive shaft 26 by fastener 30 for rotating the drive shaft in response to rotation of drive gear 32 of D.C. electric motor 34 which is supported on end wall 16 at a position for engagement of gears 28 and 32. The lead wire 36 for motor 34 extends through brace rod 28*a* for connection through control box 38 to a wall plug 40. Control box 38 houses a rheostat, transformer and rectifier.

A pair of flexible bands 42 of rubber or rubber-like compound are trained about drive shaft 26 for receiving, supporting and rotating carrier 14 as illustrated in FIG. 1. The bands thus provide a slip clutch type drive connection between the carrier 14 and drive shaft 26. Two pair of transverse pins 44 and 46 may extend between the center brace rods 20*b* and 20*e* for limiting axial movement of the bands 42.

Figure 2:
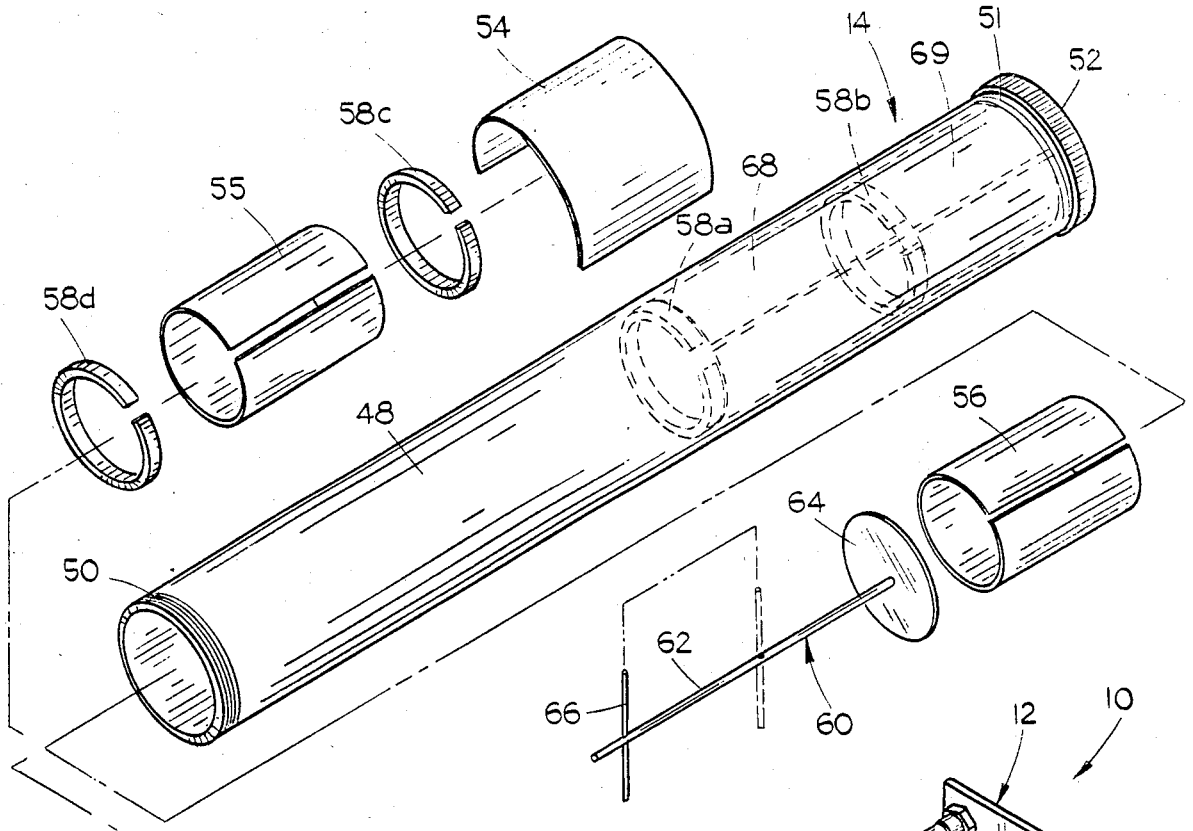
FIG. 2 is an exploded perspective view of the light tight tube with the plunger, photos and spacer rings adapted for insertion therein.

The photographic paper carrier 14 is shown in FIG. 2 as including an elongated cylindrical tube 48 having externally threaded ends 50 and 51 for detachably receiving a pair of light tight end caps 52. The precise structure of the end caps is not critical to the present invention. Any cap which can form a light tight seal with the ends of tube 48 and which provides for the flow of processing chemicals therethrough will suffice. A well-known type of end cap referred to as the Patterson cap has been satisfactorily used. Tube 48 is preferably made of a black epoxy to cooperate with the end caps for a light tight interior.

In a preferred embodiment, tube 48 has an inside diameter of $5\frac{1}{4}$ inches and a length of approximately 43 inches to accommodate the insertion of five $8\frac{1}{2}\times 11$ inch prints, three $11\times 14$ inch prints or two $16\times 20$ inch prints. The $8\frac{1}{2}$ inch prints, indicated at 54, 55 and 56 in FIG. 2 are rolled up and placed into the open end of the tube with split ring spacers 58 placed between them.

Insertion of the prints into the tube is facilitated by the use of a plunger 60 which includes a shaft 62, a disk shaped head 64 and an adjustable transverse stop bar 66. First, spacer ring 58*a* is inserted through the right hand end of tube 48 as seen in FIG. 2. The plunger is used to axially advance spacer 58*a* into the tube to the extent of engagement of stop bar 66 with the end of the tube. Print 68 is then inserted and pushed with the plunger into flush engagement against spacer 58*a*. Spacer 58*b* is inserted and followed by print 69. The end cap 52 is then placed onto threaded end 51. Next, print 54 is inserted through the left hand open end of the tube and advanced with the plunger into engagement with spacer 58*a*. This is successively followed by spacer 58*c*, print 55, spacer 58*d* and finally print 56. The other end cap 52 is then screwed onto the threaded end 50 to complete the loading of tube 48. The tube can accommodate a lesser number of larger prints, of course, without any overlapping and the plunger shaft may be provided with variously spaced holes for positioning the stop bar to accommodate the proper placement of prints of various sizes.

Referring to FIGS. 1 and 3–6, the loaded carrier 14 is inserted into the frame 12 as follows. First, one end is inserted through a respective band 42 and advanced toward the end wall for engagement of annular shoulder 70 on end cap 52 against the underside of a pair of positioning wheels 72 which are rotatably carried on fixed shafts 74 on each end wall. Wheels 72 are arranged in transversely spaced-apart relation below and on opposite sides of the drive shaft 26 and preferably below the intermediate brace rods 20*b* and 20*e*. Next, the other band 42 is then stretched around the opposite end of the carrier which is then likewise inserted into position with the annular shoulder of the end cap 52 engaged against the underside of the positioning wheel 72 on the opposite end of the frame. The flexibility of the bands 42 tends to urge the carrier upwardly for rolling engagement between the annular shoulder 70 and respective positioning wheels 72.

Figure 7:
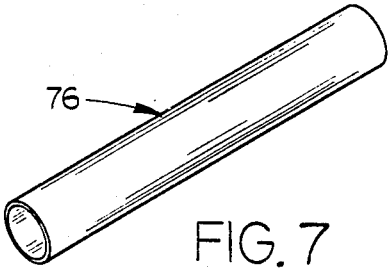
FIG. 7 is a perspective view of an alternate tube carrier.

FIG. 7 illustrates an alternate carrier 76 which simply comprises an open ended tube. Since carrier 76 is not equipped with light tight end caps, it must be used in the dark. Nevertheless, photographic paper may be loaded into carrier 76 in the same manner as previously described with tube 48. Carrier 76 is preferably somewhat longer than tube 48 so that the ends of the tube itself may be placed in rolling engagement with the underside of the positioning wheels 72. Depending upon the relative diameters of the carrier 76 and annular shoulders 70 of carrier 14, it may be useful to provide additional holes in the end walls 16 and 18 for raising or lowering the positioning wheels 72 to accommodate the respective carriers 14 and 76.

Figure 8:
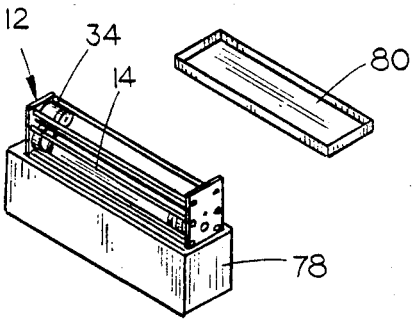
FIG. 8 is a perspective view of the paper handling device in association with a chemical processing tank.

In operation, the photographic processing chemicals are stored in individual elongated tanks 78, as shown in FIG. 8. Tank 78 has a removable dust cover 80 and preferably has an elongated rectangular shape of a size just large enough to receive the lower portion of frame 12. In a preferred embodiment of the invention, the tank 78 is 6 inches wide by 48 inches long with an inside length of $47\frac{1}{2}$ inches so that there is less than $\frac{1}{2}$ inch clearance at each end of the tank upon insertion of frame 12. The frame is lowered into the tank 78 to the extent of submersion of the carrier which is rotated by motor 34 to thoroughly expose the prints within the carrier to agitated chemicals within the carrier. After the desired processing time, frame 12 is simply lifted out of the tank where upon any chemicals in the carrier drain back into the tank. An aquarium heater may be placed in the tank to maintain the chemicals therein at the preferred temperature, perhaps 92° F. Several tanks may be provided for containing the developer, stop bath, water wash and bleach fix required for processing the prints. Frame 12 is sequentially lowered into the successive tanks until the processing is complete, whereupon the prints are removed from the carrier for drying.

Chemicals in the tanks may be replenished at the following rates to maintain the tanks in condition for continuous processing. Developer and fixer is replenished at a rate of 30 ml per square feet of paper processed and the stop bath is replenished at a rate of 60 ml per square feet of paper processed.

Figure 10:
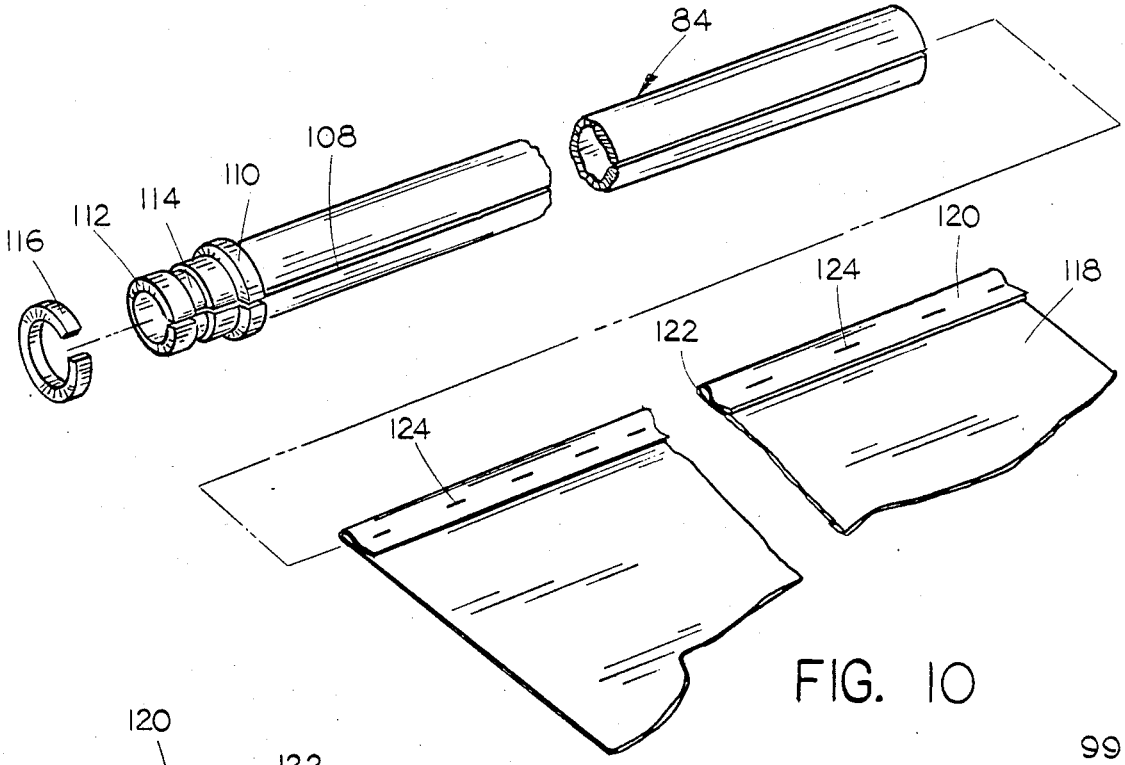
FIG. 10 is a perspective, foreshortened view of the split tube and photographic paper.
Figure 11:
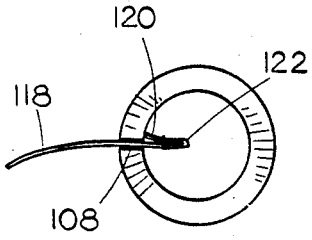
FIG. 11 is an end view showing one edge of a roll of photographic paper retentively engaged within the slit tube.
Figure 9:
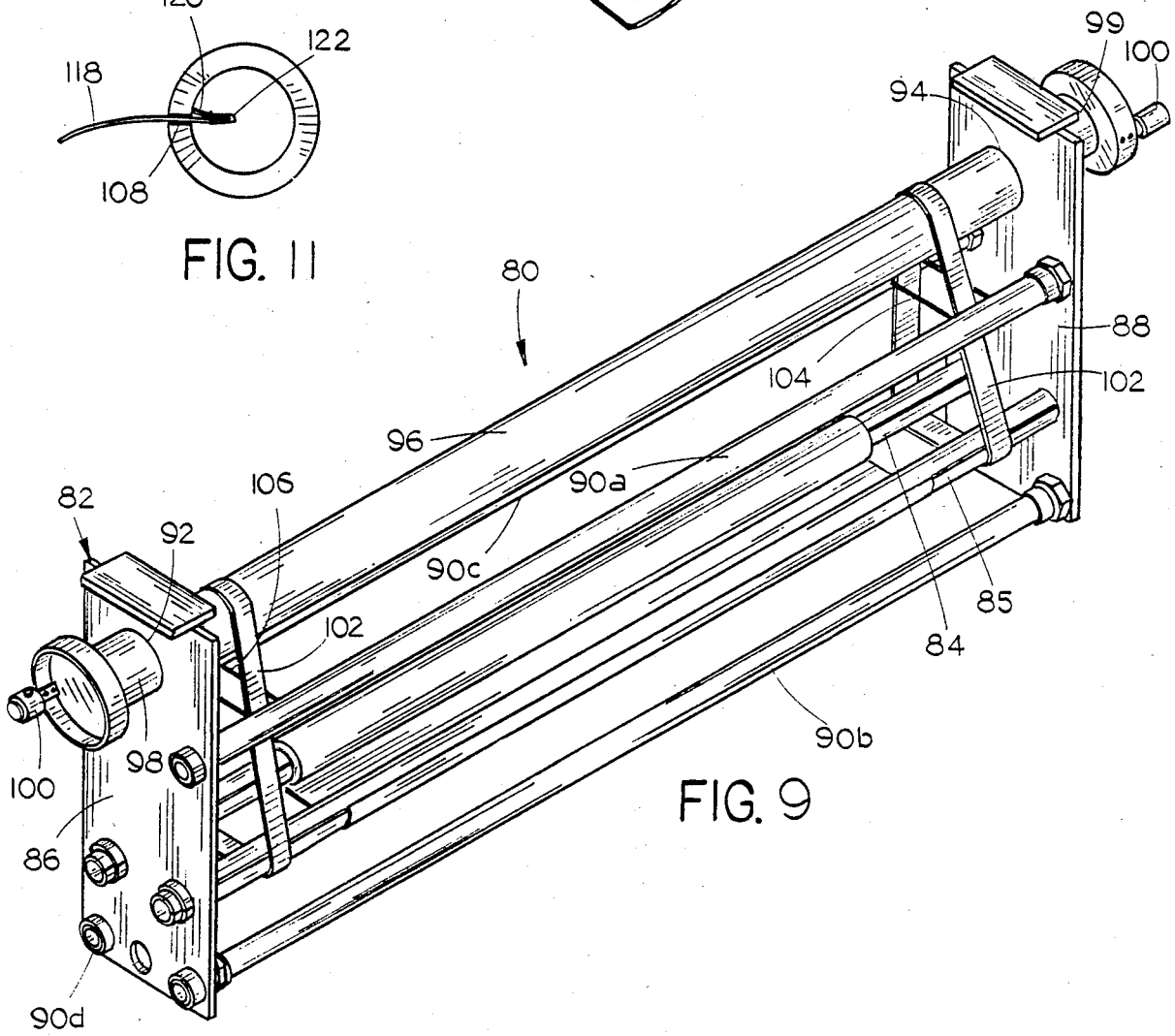
FIG. 9 is a perspective view of an alternate embodiment of the invention adapted for handling a large photographic paper rolled onto respective slit tubes.

An alternate embodiment of the invention particularly adapted for handling very large prints is illustrated in FIGS. 9–11 and designated by reference numeral 80. The paper handling device 80 includes a frame 82 and a carrier including a pair of split tubes 84 and 85. The frame 82 includes a pair of upright spaced-apart end walls 86 and 88 secured together by a plurality of brace rods 90*a–d* similar to those described in the previous embodiment. Respective openings 92 and 94 are formed in upper portions of end walls 86 and 88 to rotatably receive a somewhat large diameter drive shaft 96 equipped with enlarged end fittings 98 and 99. Each end fitting 98 and 99 carries a rotary handle 100 which acts as a crank for manual rotation of the drive shaft. A pair of flexible bands 102 are trained about the drive shaft and axially positioned between respective pairs of positioning pins 104 and 106 extended transversely between the upper brace rods 90*a* and 90*c*. Finally, the lower portion of each end wall 86 and 88 is provided with a pair of transversely spaced-apart openings adapted to rotatably receive the split tube carriers 84 and 85 as shown in FIG. 9.

The split tube carriers 84 and 85 are identical in construction so only the former is described in detail with like numerals referring to like parts of each. In FIG. 10, it is seen that the split tube 84 is preferably a cylindrical tube of PVC or another chemically inert substance. A straight slit 108 extends axially throughout the length of the tube. A collar 110 is fixed adjacent one end 112 of the tube and an annular recess 114 is provided between collar 110 and end 112. The space between collar 110 and recess 114 is only slightly wider than the thickness of the end walls 86 or 88. Collar 110 and a coacting split ring fastener 116 cooperate to axially position each split tube 84 on the frame as described below.

To load large photographic paper 118 on the order of 40 inches wide and as much as 15 feet long onto the split tube carriers, an end portion 120 at each end of the paper is folded back toward the paper along a transverse crease 122 whereupon each end portion is axially inserted into a respective slit tube 84, 85 with the paper 118 extending through the slits 108 as shown in FIG. 11. One or more staples 124 or other fasteners may be inserted through the end portions 120 and adjacent paper 118 to secure the end portions in their folded positions. The folded end portions thus resist radial withdrawal of the ends of the paper through the slits 108 and tubes 84 and 85.

In operation, an elongated paper roll is first secured to the slit tubes 84 and 85 as just described. The paper 118 is then rolled almost completely onto one tube 84. The mounting of the slit tubes 84 and 85 onto frame 82 is as follows. The plain ends of the tubes 84 and 85 are inserted through the right band 102 and then into the openings in the lower end of end wall 88. The tubes are inserted far enough to the right so that the left end can be inserted through the left band 102 and into the openings at the lower end of end wall 86. Snap ring fasteners 116 are then snapped onto the annular recesses 114 in the ends of the tubes to properly axially position the tubes by sandwiching end wall 86 between the respective collars 110 and snap ring fasteners 116.

Processing of the large paper by device 80 is carried out in the same manner as previously described with device 10 except that it is important that the paper be completely rolled back and forth between slit tubes 84 and 85 in each of the chemicals to thoroughly process the entire length of the rolled photographic paper. In the embodiment shown, drive shaft 96 is preferably rotated at approximately two revolutions per second. It is important that the paper be rolled relatively tight onto the tubes to avoid bends and creases. Danger of ripping the paper is avoided by the operation of the bands 102 which inherently afford a somewhat slip-clutch type of drive. The chemicals into which the slit tubes are submerged also act as a lubricant to prevent any damage to the paper during handling. The somewhat springy nature of modern resin coated photographic paper is advantageous for handling by the slit tubes of the invention.

Thus there has been shown and described a photographic paper handling device and method which accomplish at least all of the stated objects.

I claim:

1. A photographic paper handling device comprising a frame comprising a pair of opposite end walls having upper and lower portions, and brace means connected to and extended between said end walls for supporting said end walls in upright generally parallel spaced-apart relation, a drive shaft rotatably supported on the upper portions of said end walls, a generally cylindrical photographic paper carrier of a length adapted for placement lengthwise between said end walls, said carrier comprising a light tight tube equipped with light tight end caps on the opposite ends thereof, positioning means on said end walls for rotatably positioning said carrier between lower portions of said end walls, and drive means disengageably connecting the carrier to said drive shaft for rotation of the carrier in response to rotation of the drive shaft, said carrier being adapted to receive within it exposed photographic paper to be developed, and said carrier having ends which are open for the flow of developing chemicals therethrough whereby the handling device with the loaded carrier may be sequentially placed in successive tanks of chemicals to the extent of submersion of said carrier for developing the paper in the carrier.

2. The device of claim 1 wherein said brace means comprises a plurality of rods connected to and extended between said end plates.

3. The device of claim 2 wherein said end plates are generally rectangular and wherein said plurality of rods includes at least four rods, each rod being connected to respective corners of said end plates.

4. The device of claim 1 wherein said drive shaft extends between said end walls.

5. The device of claim 1 wherein said drive means comprises at least one flexible band trained around said drive shaft and carrier.

6. The device of claim 1 wherein said carrier comprises an open ended cylinder.

7. The device of claim 1 wherein said positioning means comprises a pair of transversely spaced-apart rollers on the interior surface of each end wall, said carrier being rotatably engageable against the underside of said rollers which thereby serve as a limit to upward movement of the carrier toward the drive shaft.

8. A photographic paper handling device, comprising a frame comprising a pair of opposite end walls having upper and lower portions and brace means connected to and extended between said end walls for supporting said end walls in upright generally spaced-apart relation, a drive shaft rotatably supported on the upper portion of at least one end wall, a pair of slit tubes of a length at least slightly longer than the spacing between said end walls, said slit tubes being adapted to receive and engage opposite ends of an elongated roll of photographic paper whereby said paper may be rolled onto at least one of said slit tubes, means for rotatably supporting said slit tubes in transversely spaced-apart relation on lower portions of said end plates, drive means disengageably connecting the slit tubes to the drive shaft for rotation of the slit tubes in response to rotation of the drive shaft for rolling the paper from one slit tube to the other whereby upon sequential lowering of the handling device into successive tanks of chemicals to the extent of submersion of the slit tubes, and upon transfer of the paper from one slit tube to the other within the chemicals, the exposed paper is developed, and said drive means comprises a flexible band trained about said drive shaft and both slit tubes.

9. The device of claim 8 wherein said end walls, slit tubes and rotatable support means are made of chemically inert materials.

10. The device of claim 8 wherein said slit tubes are made of PVC conduit.

11. The device of claim 8 further comprising means for disengageably axially securing said slit tubes relative to said end walls.

12. The device of claim 8 further comprising an elongated roll of photographic paper having opposite end portions, said end portions being folded back toward the roll along a transverse crease and each end portion being axially insertable into a slit tube with the roll of paper extending through the slit whereby said folded end portion resists radial withdrawal of the end of the roll through the slit.

13. The device of claim 12 further comprising at least one fastener securing said end portion to the portion of the roll against which it is folded.

14. A photographic paper handling device comprising a frame comprising a pair of opposite end walls having upper and lower portions, and brace means connected to and extended between said end walls for supporting said end walls in upright generally spaced-apart relation, a drive shaft rotatably supported on the upper portion of at least one end wall, a pair of slit tubes of a length at least slightly longer than the spacing between said end walls, said slit tubes being adapted to receive and engage opposite ends of an elongated roll of photographic paper whereby said paper may be rolled onto at least one of said slit tubes, means for disengageably axially securing said slit tubes relative to said end walls, including a stop collar fixed on a slit tube adjacent one end thereof, an annular recess in the slit tube axially positioned between the collar and said one end of the tube and a split ring fastener removably seated in said recess whereby, upon insertion of said one end of the tube through the end wall to the extent of engagement of the collar, the snap ring may be seated in the recess for cooperation with the collar to limit axial movement of the slit tube in opposite axial directions, means for rotatably supporting said slit tubes in transversely spaced-apart relation on lower portions of said end plates, drive means disengageably connecting the slit tubes to the drive shaft for rotation of the slit tubes in response to rotation of the drive shaft for rolling the paper from one slit tube to the other whereby upon sequential lowering of the handling device into successive tanks of chemicals to the extent of submersion of the slit tubes, and upon transfer of the paper from one slit tube to the other within the chemicals, the exposed paper is developed.

15. A method of processing exposed photographic paper comprising providing a paper handling device having spaced-apart generally vertically upstanding end walls, a generally cylindrical photographic paper carrier supported on and extended generally horizontally between lower portions of the end walls, and a drive shaft on an upper portion of the end walls and connected to the carrier for rotating the carrier, placing exposed photographic paper on the cylindrical carrier, and rotating the drive shaft while simultaneously sequentially placing the handling device with said carrier in a generally horizontal orientation in successive tanks of chemicals to the extent of submersion of said carrier.

16. The method of claim 15 wherein placing exposed photographic paper on the carrier comprises placing said paper within the cylindrical carrier.

17. The method of claim 15 wherein said carrier comprises a pair of slit tubes and placing exposed photographic paper on the carrier comprises securing opposite ends of said paper within respective slit tubes and rolling said paper onto at least one of said tubes.

* * * * *